US007802750B2

(12) United States Patent
Takeuchi

(10) Patent No.: US 7,802,750 B2
(45) Date of Patent: Sep. 28, 2010

(54) ROLLED SHEET SUPPORT MECHANISM AND PRINTER

(75) Inventor: Kiyokazu Takeuchi, Chiba (JP)

(73) Assignee: Seiko Instruments Inc. (JP)

( * ) Notice: Subject to any disclaimer, the term of this patent is extended or adjusted under 35 U.S.C. 154(b) by 304 days.

(21) Appl. No.: 11/977,571

(22) Filed: Oct. 25, 2007

(65) Prior Publication Data

US 2008/0135674 A1 Jun. 12, 2008

(30) Foreign Application Priority Data

Nov. 6, 2006 (JP) ..... 2006-300003

(51) Int. Cl.
*B65H 16/06* (2006.01)
*B41J 29/02* (2006.01)

(52) U.S. Cl. ..... 242/596.4; 242/596.7; 242/596.8; 242/599.3; 242/599.4; 242/423; 400/693

(58) Field of Classification Search ..... 242/596, 242/596.4, 596.7, 596.8, 599.3, 599.4, 423; 400/611, 613, 613.1, 617, 619, 621, 693
See application file for complete search history.

(56) References Cited

U.S. PATENT DOCUMENTS 4,821,974 A * 4/1989 Poehlein ..... 242/596.4
6,505,981 B1 * 1/2003 Takami et al. ..... 400/602
7,007,884 B2 * 3/2006 Beaucher ..... 242/423
7,018,119 B2 * 3/2006 Koyabu ..... 242/596
2005/0002721 A1 * 1/2005 Koyabu ..... 400/613
2005/0199763 A1 * 9/2005 Myers et al. ..... 242/596.3

FOREIGN PATENT DOCUMENTS

JP 2001163483 6/2001
JP 2003171037 6/2003

* cited by examiner

*Primary Examiner*—William A Rivera
(74) *Attorney, Agent, or Firm*—Adams & Wilks

(57) ABSTRACT

A rolled sheet support mechanism has two spaced-apart guide plates for accommodating therebetween a rolled sheet. A displacement member carries a pair of opposed, axially slidable bobbins and pivots between an attachment position wherein the rolled sheet can be inserted between and held by the bobbins and an accommodation position wherein the rolled sheet is ready for use. A pair of biasing members compressed between the guide plates and bobbins elastically press the bobbins to the rolled sheet. The spacing between the guide plates is larger in the region of the attachment position than in the region of the accommodation position so that when the displacement member pivots from the attachment position to the accommodation position, the biasing members slide along the guide plates and further compress to increase the force at which the bobbins press against the rolled sheet.

20 Claims, 10 Drawing Sheets

ROLLED SHEET SUPPORT MECHANISM AND PRINTER

BACKGROUND OF THE INVENTION

1. Field of the Invention

The present invention relates to a rolled sheet support mechanism for pivotally supporting a rolled sheet, and a printer having the rolled sheet support mechanism.

2. Description of the Related Art

Currently, there are provided many thermal printers of various types, for performing printing by pressing a heated thermal head to a special recording sheet, which is to be discolored when being applied with heat. In particular, without using toner, ink, or the like, smooth character printing and colorful graphic printing can be performed, so the thermal printer is suitably used for printing of various labels, receipts, tickets, or the like.

Meanwhile, the recording sheet used for the various printers represented by the thermal printer is normally used while being wound around a cylindrical core tube to be formed into a rolled sheet. In general, the rolled sheet is mounted by one of two types of methods, one of which is of a drop-in type in which the rolled sheet is dropped in an accommodation space, and the other of which is of a pivot support type in which the core tube is pivotally supported (supported so as to freely rotate).

Of those, as one of the pivot support types, there is known a support structure for a rolled sheet, capable of rotatably supporting the rolled sheet and easily performing a replacement operation of the rolled sheet (see, for example, JP 2003-171037 A). The support structure for the rolled sheet includes a pair of support members each biased by an elastic member such as a coil spring toward an inside of a rolled paper container in which the rolled sheet is accommodated. The pair of support members each have, at an end thereof, a tapered tip portion to be fitted into a hollow hole of the rolled sheet. That is, the pair of support members can support the rolled sheet while pressing the rolled sheet by fitting the tip portions into the hollow hole from both sides thereof. That is, outer surfaces of the tip portions each formed into the tapered shape abut on inner edges of the hollow hole of the rolled sheet, thereby making it possible to retain the rolled sheet while pressing the rolled sheet from the both sides thereof. In this case, a biasing force of the elastic member is adjusted such that the rolled sheet is rotatable.

Further, the support members are merely biased by the elastic members. Therefore, receiving a force in a reverse direction with respect to a biasing direction, the support members move in the direction thereof, thereby allowing the rolled sheet to be attached.

According to the support structure for a rolled sheet, the replacement can be performed by a simple operation of only putting in or pulling out the rolled sheet into or from the rolled sheet accommodating portion. Further, the pair of the support members retain the rolled sheet by pressing the rolled sheet from the both sides of the hollow hole, so the rolled sheet can be pivotally supported with reliability.

However, there still remain the following problems with the conventional support structure for a rolled sheet described above.

That is, since the above-mentioned support structure for a rolled sheet is structured such that the pair of support members are pressed to the both sides of the hollow hole with the biasing force by the elastic members to support the rolled sheet by sandwiching the rolled sheet from the both sides thereof, a pressing force (biasing force) for sandwiching the rolled sheet is required to be set to a relatively large value. This is because, if the pressing force is small, there is a risk in that, when the rolled sheet rotates, the support members are detached due to vibration or the like, thereby causing the rolled sheet to fall off. In particular, the unused rolled sheet which has been just replaced is heavy, thus tending to fall off. Accordingly, in order to enable reliable supporting of even the unused rolled sheet, the pressing force is required to be adjusted to a large value in advance.

On the other hand, when the rolled sheet is attached, the pair of support members are required to be moved with a force standing against the biasing force of the elastic member so as to be spaced apart from each other in a lateral direction. However, when the pressing force is adjusted to the large value as described above, it is required to apply a force to the rolled sheet such that a force stronger than the pressing force is applied to the support members at the time of attachment of the rolled sheet. As a result, mountability of the rolled sheet is low and a replacement operation takes time and effort. Further, during the replacement, the support member continuously abuts on the side surface of the rolled sheet with the strong biasing force, so there is a risk of deformation that the side surface of the rolled sheet is dented.

As described above, in the conventional support structure for a rolled sheet, in order to prevent the rolled sheet from falling off, it is required to set the pressing force of the pair of support members to the large value, so there arise the several problems described above.

SUMMARY OF THE INVENTION

The present invention has been made in view of the above-mentioned circumstances. It is therefore an object of the present invention to provide a rolled sheet support mechanism and a printer having the rolled sheet support mechanism, capable of enhancing mountability of a rolled sheet while preventing the rolled sheet from falling off, and further facilitating a replacement operation.

The present invention provides the following means to achieve the above-mentioned object.

A rolled sheet support mechanism according to the present invention is characterized by including a rolled sheet support mechanism for pivotally supporting a rolled sheet obtained by winding a recording sheet around a cylindrical core tube, the rolled sheet support mechanism being characterized by including: a pair of guide plates arranged in parallel to each other while sandwiching the rolled sheet therebetween, and opposed to side surfaces of the rolled sheet; a pair of support members arranged between the rolled sheet and the pair of guide plates, and having, at ends thereof, insertion portions to be partially inserted into opening portions of the core tube, which are exposed to the side surfaces of the rolled sheet; a displacement member displaced between an attachment position and an accommodation position for the rolled sheet while supporting the pair of support members movably in an axial direction of the core tube, with the pair of support members being moved along the guide plates when receiving an external force; and a biasing member arranged between each of the guide plates and each of the support members, for biasing the support member with an elastic force in such a direction that the support member is spaced apart from the guide plate and pressing the insertion portion to the core tube in a state where the insertion portion is partially inserted into the opening portion to allow the rolled sheet to be pivotally supported, and in that the pair of guide plates have a distance therebetween, which becomes smaller from the attachment position toward the accommodation position.

In the rolled sheet support mechanism according to the present invention, when the pair of support members are positioned in the attachment position, the rolled sheet is mounted. In order to perform the mounting, first, while holding the rolled sheet by a hand, the rolled sheet is pushed into a space between the pair of support members. In this case, the rolled sheet is pushed in with a force standing against the elastic force of the biasing members biasing the pair of support members. The pair of support members are then pressed by the rolled sheet to be moved so as to be spaced apart from each other. That is, the pair of support members move along the axial direction of the core tube so as to approach sides of the guide plates. Further, the pair of support members are biased by the elastic force caused by the biasing members. Therefore, after the rolled sheet is pushed in, the insertion portions are continuously brought into contact with the rolled sheet.

When the opening portions of the core tube, exposed to the side surfaces of the rolled sheet, reach positions of the insertion portions as a result of continuously pushing in the rolled sheet, the each insertion portion which is biased is partially inserted into the each opening portion so as to fit therein. That is, the pair of support members are pressed to the core tube, thereby making it possible to support the core tube by sandwiching the core tube from the both sides thereof. In this case, a part of the insertion portions are merely pressed while being inserted into the opening portions, so the core tube and the rolled sheet are in a rotatable state. As a result, the rolled sheet can be pivotally supported in the attachment position.

After the rolled sheet is mounted, the displacement member is displaced from the attachment position to the accommodation position. In this case, the displacement member may be displaced by directly applying a force to the displacement member, or may be displaced by transmitting the force to the displacement member through the rolled sheet and the pair of support members. As a result, the rolled sheet and the pair of support members are integrally moved to the accommodation position. In this case, the pair of support members move along the guide plates.

Here, the pair of guide plates are designed such that a distance therebetween becomes smaller from the attachment position toward the accommodation position. Therefore, there is obtained a state where the pair of support members are pressed to the core tube through the intermediation of the biasing members. That is, the distance between the pair of guide plates is smaller than that in the attachment position, so the biasing member is compressed, thereby increasing the elastic force. Thus, the support members can be pressed to the core tube with a stronger force. As a result, the rolled sheet can be pivotally supported by being sandwiched with the stronger force.

Note that, when removing the rolled sheet, the displacement member is moved in the reverse direction to allow the rolled sheet to be positioned in the attachment position, and then, an operation reverse to that at the time of mounting is performed, thereby achieving the removal.

As described above, the distance between the pair of guide plates is mechanically changed between the attachment position and the accommodation position, so the pressing force of the supporting members can easily be changed. Accordingly, even in a case where the rolled sheet is unused, that is, being heavy, falling off of the rolled sheet can be prevented. On the other hand, when replacing the rolled sheet, the pressing force of the support members can be weakened in the attachment position, so an attachment operation of the rolled sheet can easily be performed in a way similar to that of the drop-in type.

As described above, by the rolled sheet support mechanism according to the present invention, it is possible to simultaneously achieve prevention of falling off of the rolled sheet and facilitation of the attachment operation at the time of replacement which have conventionally been difficult. Further, when attaching the rolled sheet, the insertion portion is not pressed to the side surface of the rolled sheet with a strong force, so it is possible to prevent such deformation that the side surface of the rolled sheet is dented.

Further, the rolled sheet support mechanism according to the present invention is characterized in that, in the above-mentioned rolled sheet support mechanism of the present invention, the insertion portion is formed into a tapered shape having a diameter gradually reduced toward the opening portion.

In the rolled sheet support mechanism according to the present invention, the insertion portion is formed in a tapered shape, so when attaching the rolled sheet, a direction of a force can easily be converted to a direction of an axis of the core tube. Accordingly, the pair of support members can be moved in the axial direction more smoothly, and the replacement operation can be further facilitated. Further, when the rolled sheet is pivotally supported, a tapered surface can be pressed to an inner edge of the core tube, so the rolled sheet can be pivotally supported more reliably.

Further, the rolled sheet support mechanism according to the present invention is characterized by further including, in the above-mentioned rolled sheet support mechanism of the present invention, a positioning member between the displacement member and the guide plate, for positioning, when the rolled sheet is not mounted, the pair of support members in predetermined positions with respect to the axial direction.

In the rolled sheet support mechanism according to the present invention, there are provided the positioning members, so it is possible to allow the pair of support members to be positioned continuously in the same positions with respect to the axial direction. That is, when the rolled sheet is not mounted, the insertion portions can continuously be retained in the same positions with respect to the pair of guide plates. Accordingly, when mounting the rolled sheet, the rolled sheet can be mounted without being caught or the like, and every time with the same sense of touch. Thus, the mountability can be improved more.

Further, the rolled sheet support mechanism according to the present invention is characterized in that, in one of the above-mentioned rolled sheet support mechanisms of the present invention, when receiving the external force, the displacement member rotates and simultaneously displaces the pair of support members between the attachment position and the accommodation position.

In the rolled sheet support mechanism according to the present invention, when attaching the rolled sheet, the displacement member is rotated, thereby making it possible to displace the rolled sheet and the pair of support members between the attachment position and the accommodation position. Accordingly, unlike in a case of linear displacement, a small space can effectively be utilized, thereby achieving downsizing. Further, as compared to the case of the linear displacement, the attachment position and the accommodation position can be clearly distinguished, so usability is high.

Further, the rolled sheet support mechanism according to the present invention is characterized in that, in the above-mentioned rolled sheet support mechanism of the present invention, the displacement member also serves as a cover member for covering the rolled sheet.

In the rolled sheet support mechanism according to the present invention, when the rolled sheet is positioned in the accommodation position, the displacement member can serve as the cover member for the rolled sheet, so dirt or dust does not easily adhere to the rolled sheet.

Further, the rolled sheet support mechanism according to the present invention is characterized in that, in one of the above-mentioned rolled sheet support mechanisms of the present invention, the pair of guide plates are provided with resistance application members for applying rotation resistance by pressing the side surfaces of the rolled sheet while sandwiching the rolled sheet from both sides thereof in a case where, when the rolled sheet is positioned in the accommodation position, a diameter of the rolled sheet is equal to or more than a certain value.

In the rolled sheet support mechanism according to the present invention, when the rolled sheet having the diameter equal to or more than a certain value (for example, in an unused state) is positioned in the accommodation position, the resistance application members press the side surfaces of the rolled sheet by sandwiching the rolled sheet from both sides thereof, thus applying rotation resistance. As a result, excessive rotation due to an inertial force can be prevented, and sag at the time of rotation, that is, overrun can be prevented. Note that, with regard to application of rotation resistance, not only the resistance application members, but also the pair of support members pressed to the both sides of the core tube contribute in the same manner. Accordingly, in a case where the diameter of the rolled sheet is equal to or more than the certain value (when a weight is large, so an inertial force is large), by both the resistance application members and the pair of support members, the excessive rotation can effectively be prevented.

On the other hand, in a case where a residual amount of the rolled sheet is small, thereby resulting in a small-diameter rolled sheet state in which the diameter is less than the certain value, the rotation resistance only by the pair of support members is applied. However, even in this case, the inertial force becomes smaller in correspondence with the diameter, so the excessive rotation can be prevented, thereby making it possible to prevent the overrun.

As described above, since there is provided the resistance application members, even in the case where the diameter of the rolled sheet is large, the optimum rotation resistance can be applied, thereby making it possible to reliably prevent the overrun.

Further, a thermal printer according to the present invention is characterized by including: one of the above-mentioned rolled sheet support mechanisms according to the present invention; a thermal head having a plurality of heat generating elements and extending in a width direction of the recording sheet; a platen roller having a peripheral surface which can come into contact with the thermal head in a state where the recording sheet drawn out from the rolled sheet is sandwiched therebetween, for sending out the recording sheet through rotation; and a cutting member for cutting the recording sheet which has passed the thermal head.

In the thermal printer according to the present invention, when the platen roller is rotated, the rolled sheet pivotally supported by the rolled sheet support mechanism rotates, and the recording sheet drawn out from the rolled sheet is sent out in one direction while being sandwiched between the peripheral surface of the platen roller and the thermal head. At the same time, by the thermal head in which the plurality of heat generating elements generate heat as appropriate, it is possible to clearly print various characters, figures, or the like on the recording sheet which is sent out. After that, the printed recording sheet is appropriately cut by the cutting member. As a result, the recording sheet wound to be the rolled sheet can be used for receipts, tickets, or the like.

In particular, there is provided the above-mentioned rolled sheet support mechanism, the rolled sheet can be pivotally supported continuously in a stable manner, and the replacement operation can easily be performed. Accordingly, reliability as the printer can be enhanced, and usability and maintainability can be improved.

According to the rolled sheet support mechanism according to the present invention, while preventing falling off of the rolled sheet, the mountability of the rolled sheet can be improved, so the reliability can be enhanced and the replacement operation can be facilitated.

Further, according to the thermal printer of the present invention, there is provided the above-mentioned rolled sheet support mechanism, so the reliability as the printer can be enhanced, and usability and maintainability can be improved.

DETAILED DESCRIPTION OF THE PREFERRED EMBODIMENT

Hereinafter, an embodiment of a rolled sheet support mechanism and a thermal printer according to the present invention will be described with reference to FIGS. 1 to 10. Note that, in FIGS. 4, 5, 8, and 10, in order to easily understand the invention, a later-described casing 3 and apart of a cover member 22 are omitted, are simplified in structure, or the like, thereby simplifying illustration.

Figure 1:
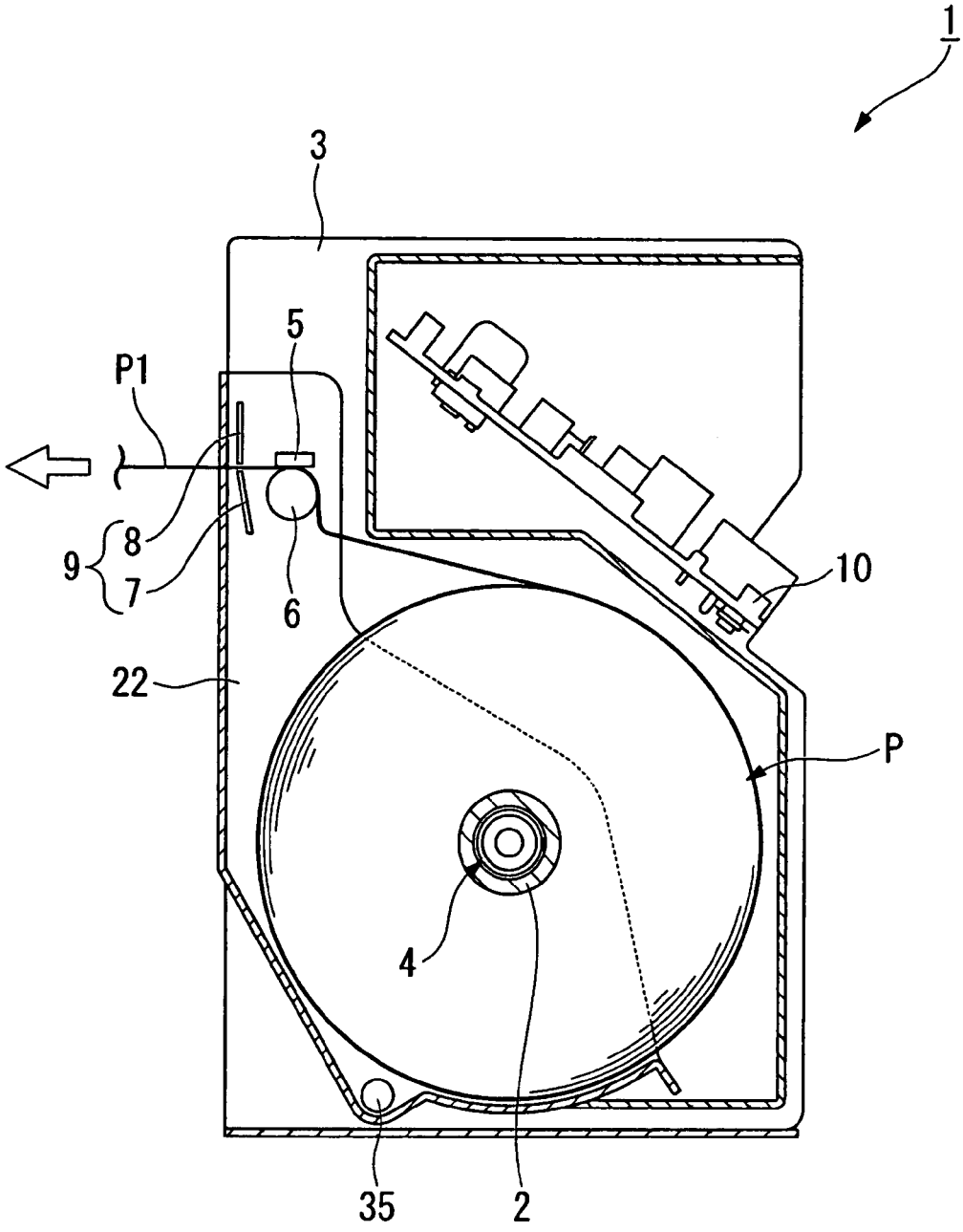
FIG. 1 is a sectional view of a thermal printer according to the present invention, showing a state where a rolled sheet is set to an accommodation position.
Figure 2:
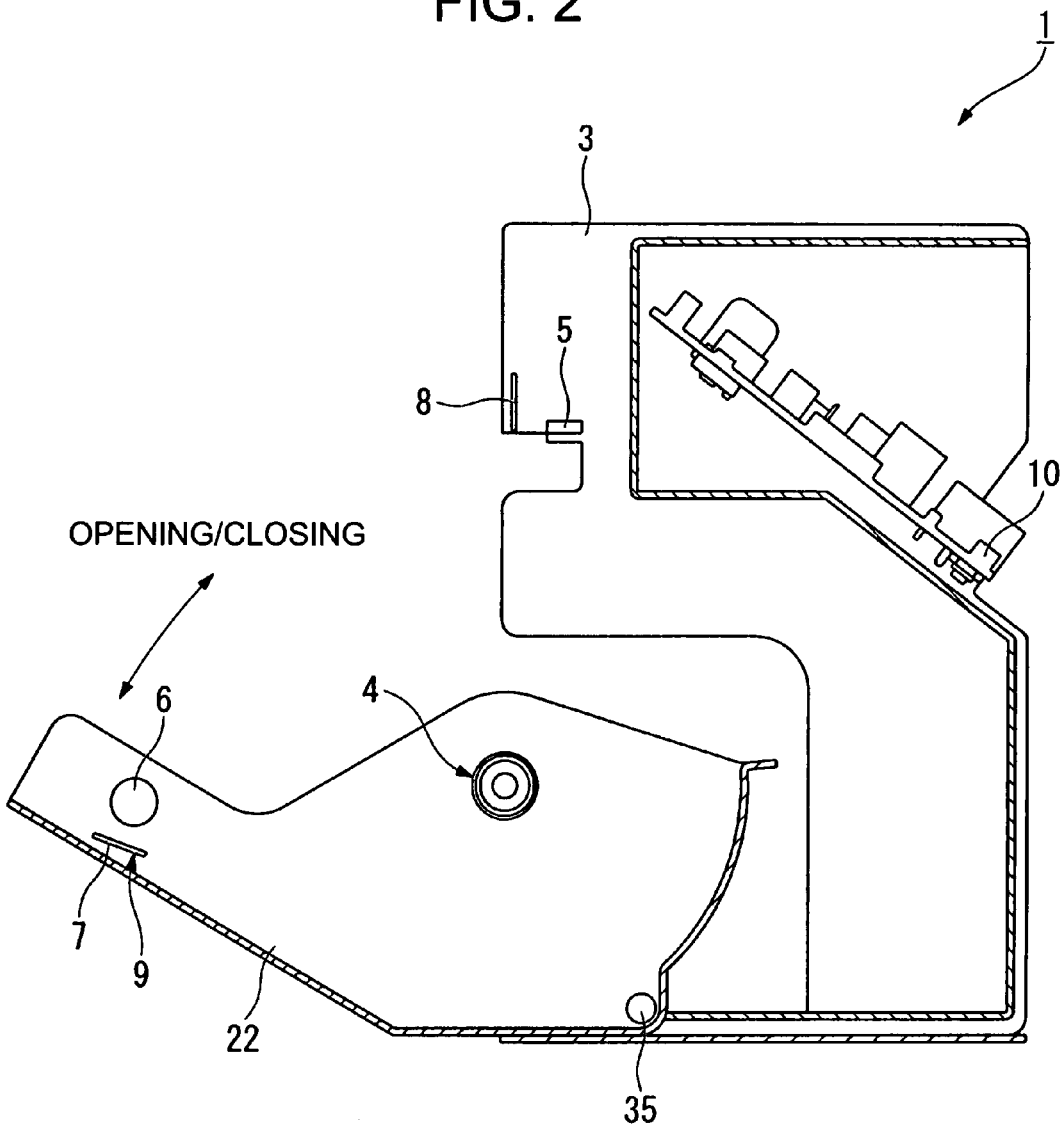
FIG. 2 is a sectional view showing a state where a cover member of the thermal printer of FIG. 1 is opened and the rolled sheet is not mounted.
Figure 3:
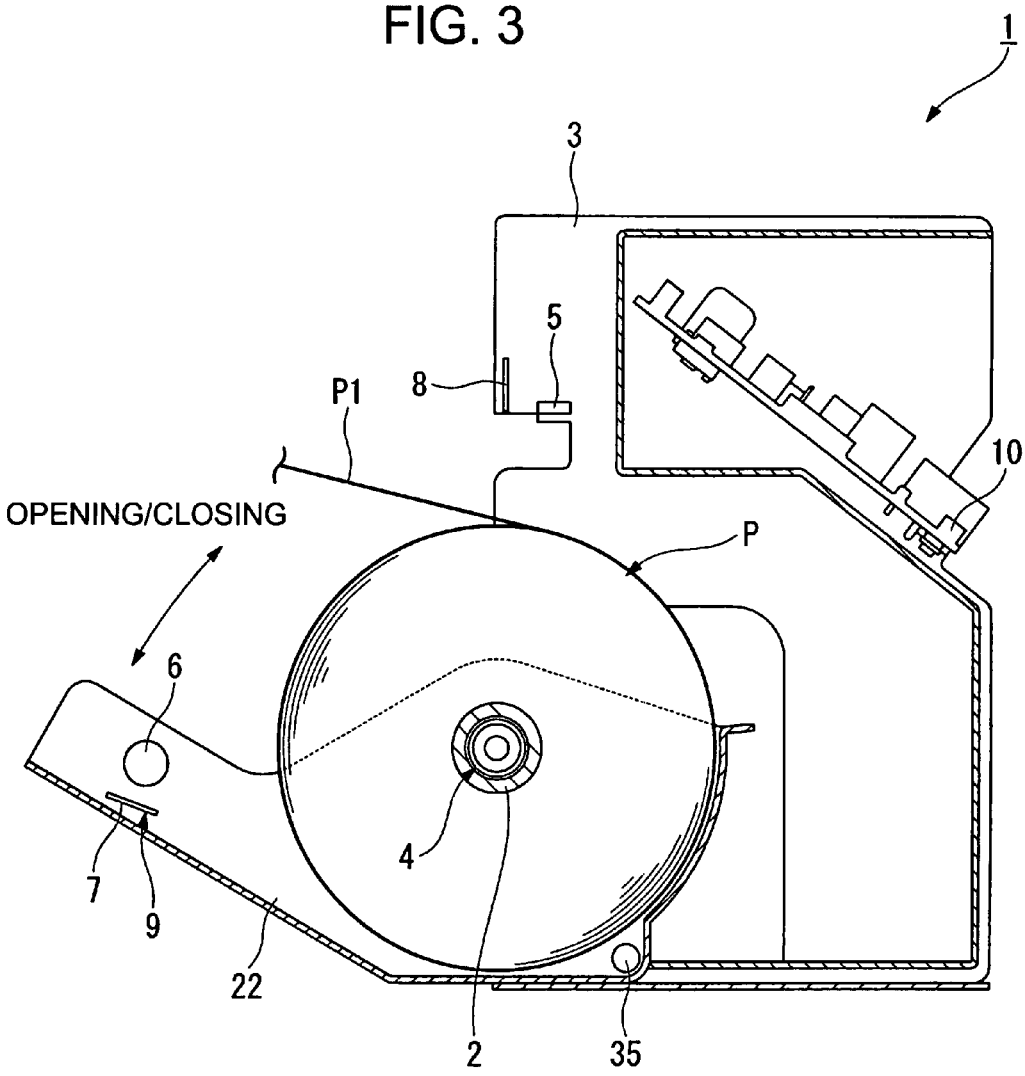
FIG. 3 is a view showing a state where, in the state of FIG. 2, the rolled sheet is set, a recording sheet is then drawn out to some extent.

A thermal printer 1 according to this embodiment includes, as shown in FIGS. 1 to 3, the casing 3 for accommodating a rolled sheet P obtained by winding a recording sheet P1 around a cylindrical core tube 2, a rolled sheet support mechanism 4 for pivotally supporting the rolled sheet P, a thermal head 5, a platen roller 6, a first cutting blade 7, and a second cutting blade 8.

The casing 3 is a casing formed by extrusion molding of plastic such as polycarbonate, or made of a metallic material, and is formed in a substantially cuboid shape. To a front surface of the casing 3, the recording sheet P1 which is drawn out from the rolled sheet P can be sent out, and the cover member (displacement member) 22 for the rolled sheet support mechanism 4 described later is fixed so as to be capable of opening and closing. Further, on the front surface of the casing 3, as shown in FIG. 2, an opening for allowing attachment of the rolled sheet P is formed when the cover member 22 is opened. Further, side surfaces of the casing 3 of this embodiment also serve as a pair of guide plates 20 for the rolled sheet support mechanism 4.

The above-mentioned thermal head 5 has a plurality of heat generating elements (not shown), extends in a width direction of the recording sheet P1, and is provided on a side of the front surface of the casing 3. The thermal head 5 is biased to the platen roller 6 side by a coil spring or the like (not shown).

The platen roller 6 is provided to the cover member 22 side such that, when the cover member 22 is closed with respect to the casing 3, a peripheral surface of the platen roller 6 comes into contact with the thermal head 5 while sandwiching the recording sheet P1, which is drawn out from the rolled sheet P, therebetween. Further, the platen roller 6 has an end side to which a driven gear (not shown) is fixed so as to engage with a gear transmission mechanism (not shown) rotated by a motor. As a result, the platen roller 6 can be rotated by a rotation driving force from the motor and can send out the recording sheet P1 forwardly of the casing 3.

Further, the cover 22 is provided with the first cutting blade 7 in the vicinity of the platen roller 6. When the cover member 22 is closed with respect to the casing 3, the first cutting blade 7 moves along the second cutting blade 8 fixed to the casing 3 side. As a result, the recording sheet P1 which has passed the thermal head 5, that is, the recording sheet P1 on which printing is performed can be cut. The first and second cutting blades function as a cutting member 9 for cutting the recording sheet P1.

Further, in the casing 3, there is provided a control board 10 on which various electronic equipment are mounted. The control board 10 performs general control of various components by outputting an electronic signal or a control signal to the thermal head 5, and by outputting the control signal to the motor for driving the platen roller.

Figure 4:
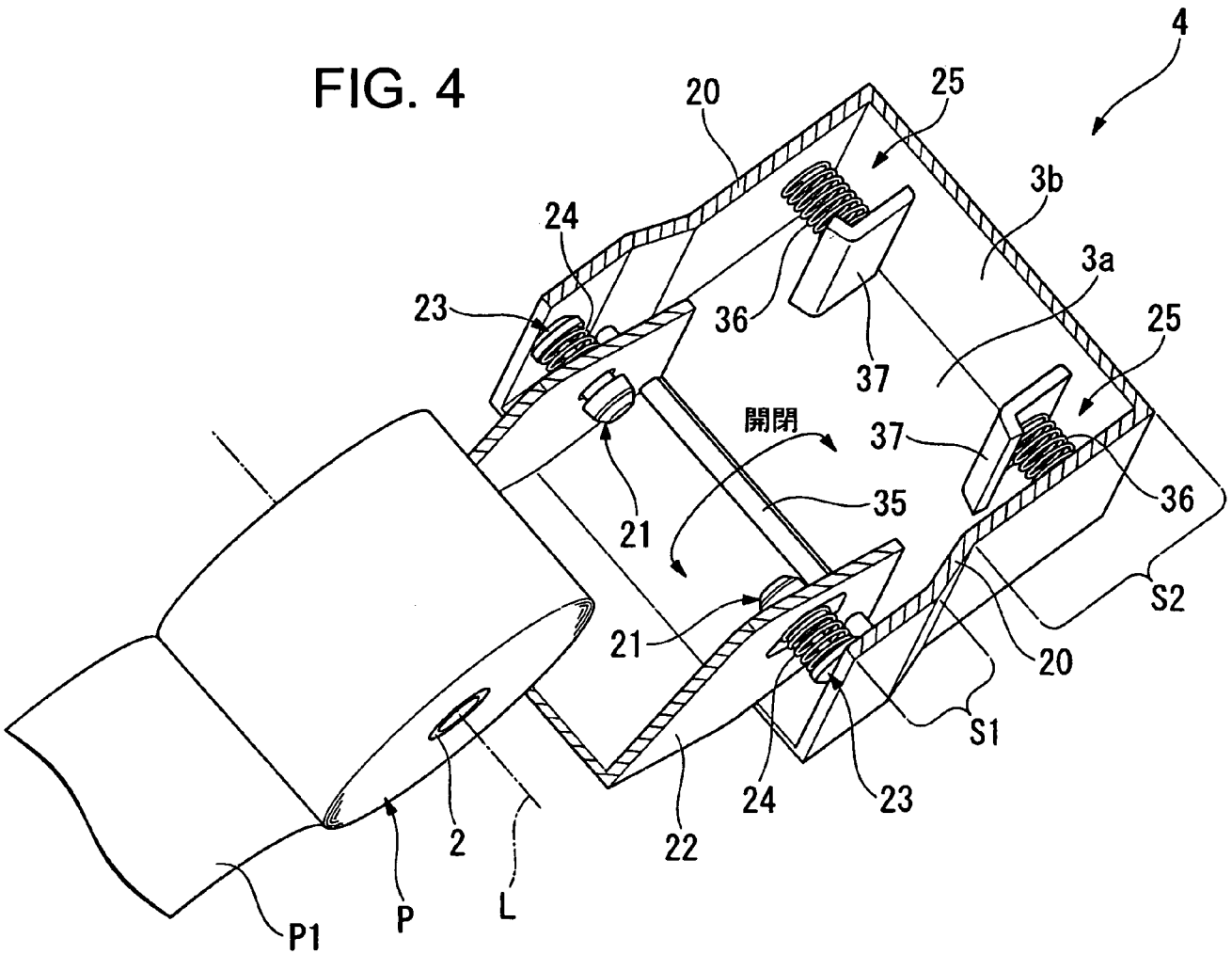
FIG. 4 is a perspective view of a rolled sheet support mechanism incorporated in the thermal printer of FIG. 1.

Subsequently, the above-mentioned rolled sheet support mechanism 4 will be described with reference to FIGS. 4 to 8. The rolled sheet support mechanism 4 includes, as shown in FIG. 4, the pair of guide plates 20, a pair of bobbins (support members) 21, the cover member 22, a biasing member 23, a bobbin off spring (positioning member) 24, and a resistance application member 25.

The pair of guide plates 20 are members which also serve as the side surfaces of the casing 3, are arranged in parallel spaced-apart relation to each other while sandwiching the rolled sheet P therebetween, and are opposed to side surfaces of the rolled sheet P. Note that, in FIG. 4, there are shown a bottom surface 3*a* and a rear surface 3*b* of the casing 3, which are formed integrally with the guide plates 20. The pair of guide plates 20 have opposed first portions and opposed second portions which are designed such that a distance therebetween mechanically decreases from an attachment position S1 (first portions), where the rolled sheet P is attached, toward an accommodation position S2 (second portions), where the rolled sheet P is accommodated in the casing 3. That is, an interval between the pair of guide plates 20 is, as shown in FIG. 5, T1 between the opposed first portions in the attachment position S1, and is T2, which is smaller than T1, between the opposed second portions in the accommodation position S2.

Figure 5:
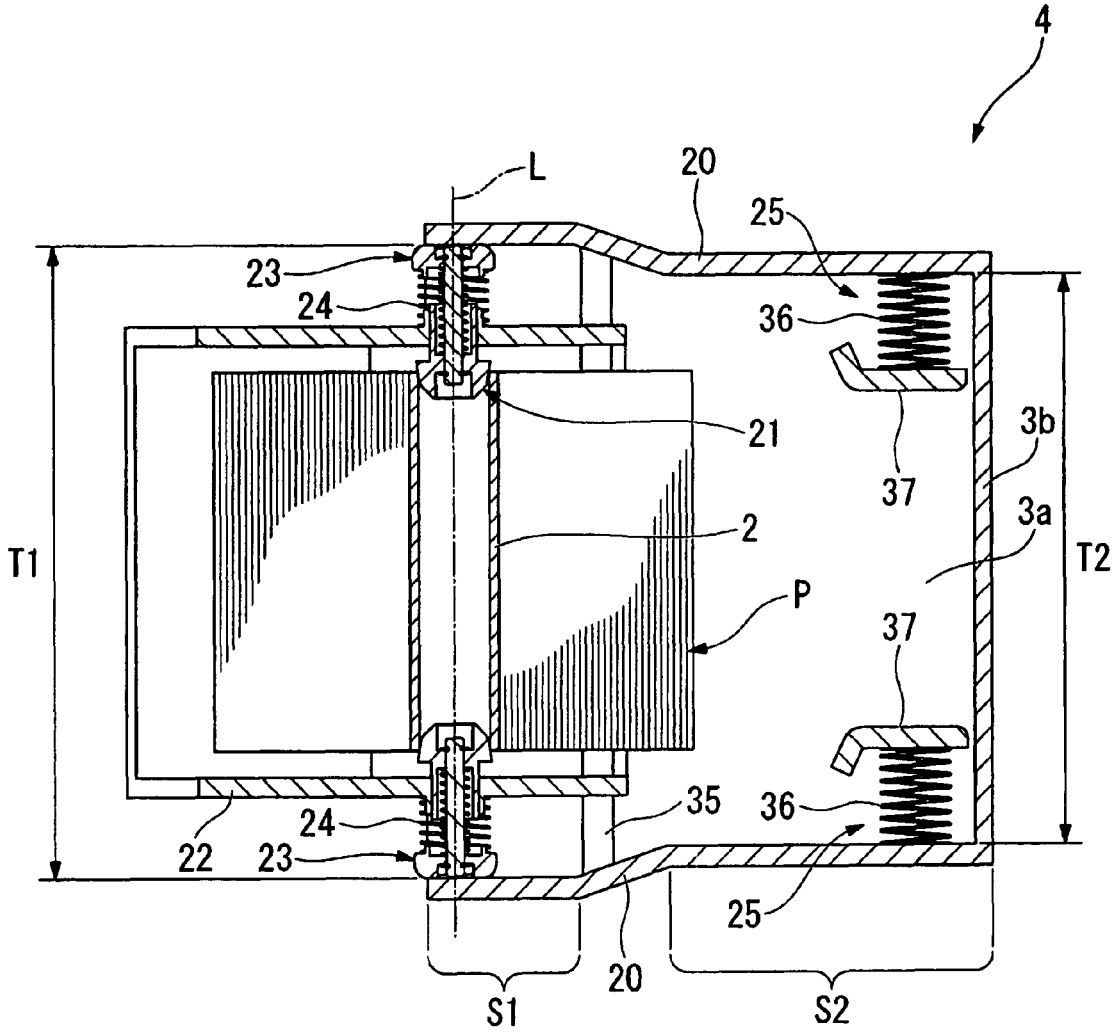
FIG. 5 is a sectional view showing a state where, in an attachment position, the rolled sheet is set to the rolled sheet support mechanism of FIG. 4.
Figure 6:
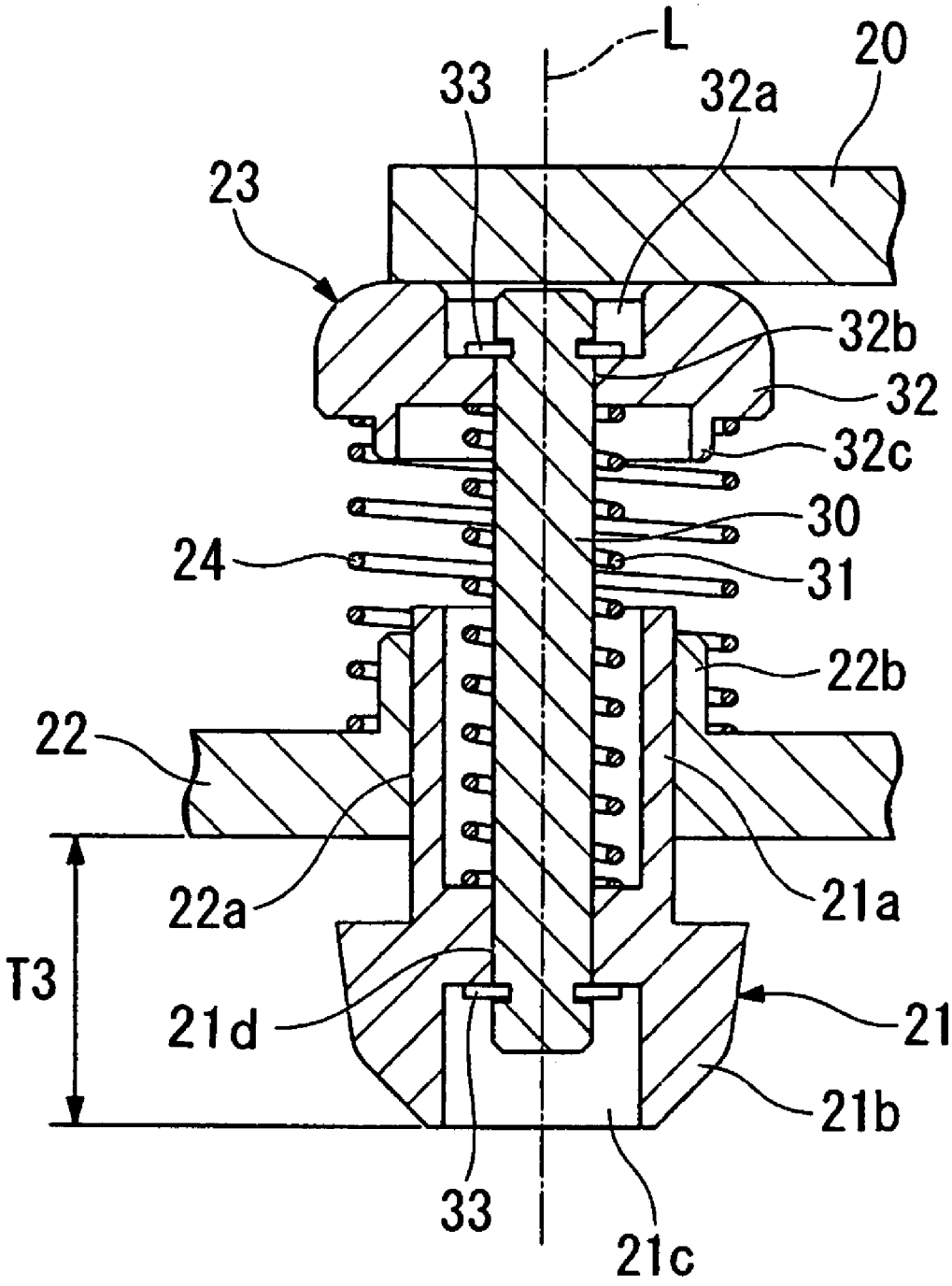
FIG. 6 is an enlarged sectional view of the vicinity of a bobbin in the attachment position.
Figure 7:
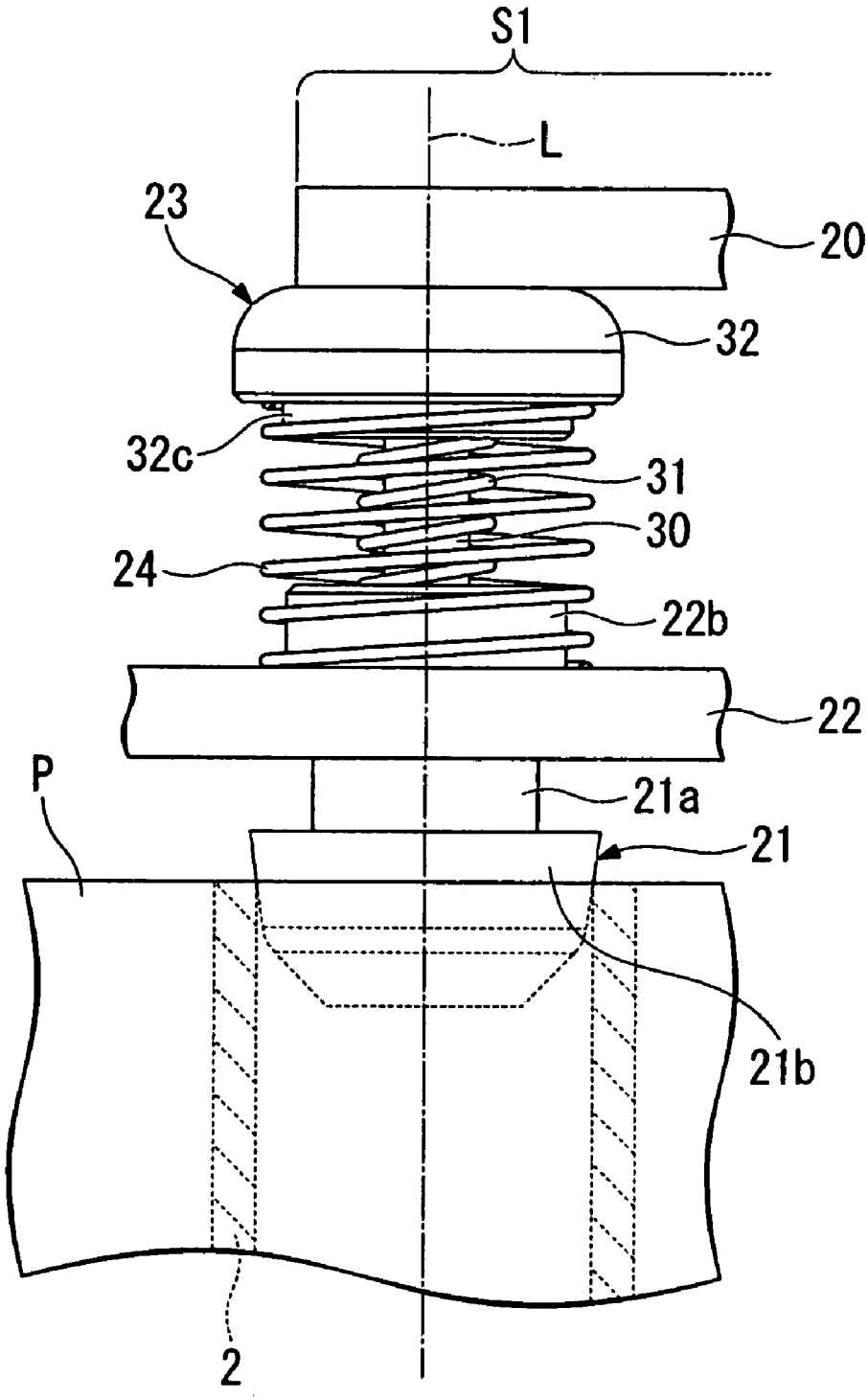
FIG. 7 is an enlarged view of the vicinity of the bobbin in the state of FIG. 5.

Each of the pair of bobbins 21 is arranged, as shown in FIGS. 5 to 7, between the rolled sheet P and each of the guide plates 20, and is formed of a base end portion 21*a* having a cylindrical shape and an insertion portion 21*b* formed on a distal end of the base end portion 21*a* and partially inserted into an opening portion of the core tube 2 exposed to the side surface of the rolled sheet P. The bobbin 21 is made of a fluororesin or the like, for example.

As illustrated, the cover member (displacement member) 22 has a pair of opposed spaced-apart wall portions on which are mounted the bobbins 21. Further, the bobbin 21 has the base end portion 21*a* inserted into a through hole 22*a* formed in a wall portion of the cover member 22, and is supported by the cover member 22 so as to be movable in a direction of an axis L of the core tube 2. Further, the insertion portion 21*b* of this embodiment is formed in a tapered shape having a diameter gradually decreasing toward the opening portion of the core tube 2. As a result, a tapered surface comes into line contact with an inner edge of the core tube 2 in a state where the insertion portion 21*b* is partially inserted into the core tube 2. Further, at a center of the insertion portion 21*b*, an opening portion 21*c* is bored. Between the opening portion 21*c* and an inner portion of the base end portion 21*a*, there is formed a through hole 21*d* for allowing a later-described shaft 30 to communicate therethrough.

The biasing member 23 is formed of a shaft 30, a bobbin pressing spring 31, and an end plate 32, and is arranged between the guide plate 20 and the bobbin 21. The biasing member 23 biases the bobbin 21 by an elastic force in such a direction that the bobbin 21 is spaced apart from the guide plate 20 to press a part of the insertion portion 21*b* to the core tube 2 with the part being inserted into the opening portion of the core tube 2, thereby allowing the rolled sheet P to be pivotally supported.

The shaft 30 is inserted into the through hole 21*d* of the bobbin 21 and is movable along the direction of the axis L. Further, one end side of the shaft 30 is fixed to a C pin 33 abutting on a wall surface of the opening portion 21*c*. As a result, when the bobbin 21 is biased by the bobbin pressing spring 31, the shaft 30 does not fall off.

The end plate 32 is made of a fluororesin or the like similarly to the bobbin 21. At a center of the end plate 32 on the guide plate 20 side, an opening portion 32*a* is bored, and a through hole 32*b* allowing passage of the shaft 30 therethrough is formed. To an inside of the through hole 32*b*, the other end side of the shaft 30 is press-fitted and fixed. Like on the one end side, the C pin 33 is also fixed to the other end side of the shaft 30.

Further, between the end plate 32 and the bobbin 21, the bobbin pressing spring 31 is arranged while being fitted to the shaft 30. The bobbin 21 is biased in such a direction that the bobbin 21 is spaced apart from the guide plate 20 by the bobbin pressing spring 31, that is, toward the core tube 2 side. As a result, as described above, the part of the insertion portion 21*b* is inserted into the opening portion of the core tube 2.

Between the wall portion of the cover member 22 and the end plate 32, there is arranged the bobbin off spring 24. The bobbin off spring 24 is arranged while surrounding the shaft 30 and the bobbin pressing spring 31, and has one end side fitted on a protruding portion 22*b* of the cover member 22 and the other end side fitted on a protruding portion 32*c* of the end plate 32. The end plate 32 is biased by the bobbin off spring 24, thereby continuously being brought into surface contact with the guide plate 20. As a result, when the rolled sheet P is not mounted, the bobbin 21 can be positioned in a predetermined position with respect to the direction of the axis L. That is, as shown in FIG. 6, a protruding amount T3 of the bobbin 21 with respect to the cover member 22 can continuously be regulated to a fixed amount.

The above-mentioned cover member 22 has a pair of opposed spaced-apart wall portions which are, as shown in FIG. 4, rotatably connected to a rotary shaft portion 35 fixed to the pair of guide plates 20, and the cover member is opened and closed in a range of a certain angle. As a result, in a state where the cover member 22 supports the pair of bobbins 21 movably in the direction of the axis L, when receiving an external force, the cover member 22 can be displaced between the attachment position S1 and the accommodation position S2 for the rolled sheet P with the bobbins 21 moving along the guide plates 20. In particular, in this embodiment, the cover member 22 is displaced while being rotated. Further, as shown in FIG. 1, when the rolled sheet P and the bobbin 21 reach the accommodation position S2, the cover member 22 covers the rolled sheet P while coming into intimate contact with the casing 3. Accordingly, dust, dirt, or the like does not adhere to the rolled sheet P.

Further, to each of the pair of guide plates 20, as shown in FIGS. 4 and 5, a compression spring 36 extending along the direction of the axis L is fixed so as to be near the rear surface 3*b* of the casing 3. To an end of the compression spring 36, a compression plate 37 brought into surface contact with the side surface of the rolled sheet P is fixed. In a case where the rolled sheet P is positioned in the accommodation position S2, when a diameter of the rolled sheet P is equal to or more than a certain value (for example, when a residual amount of the rolled sheet P is equal to or more than a half thereof), the compression springs 36 and the compression plates 37 press the side surfaces of the rolled sheet P while sandwiching the rolled sheet P to apply rotation resistance. That is, the compression spring 36 and the compression plate 37 constitute the resistance application member 25 described above.

Next, a description will be made of a case where, after the unused rolled sheet P is mounted to the thermal-printer 1 structured as described above, information of various kinds are printed on the rolled sheet P.

First, as shown in FIG. 2, by opening the cover member 22, the opening for introducing the rolled sheet P is secured on the front surface of the casing 3. In this case, as shown in FIG. 4, the pair of bobbins 21 are positioned in the attachment position S1 for the rolled sheet P. Next, the rolled sheet P is pushed into a space between the pair of bobbins 21 while being held by a hand. In this case, the rolled sheet P is pushed in with a force which stands against the spring force (elastic force) of the bobbin pressing springs 31 biasing the bobbins 21. The pair of bobbins 21 then move so as to be spaced apart from each other by being pushed by the rolled sheet P. That is, the pair of bobbins 21 move along the direction of the axis L of the core tube 2 so as to approach the respective guide plates 20. Further, the pair of bobbins 21 are biased with the spring force by the bobbin pressing springs 31. Therefore, after the rolled sheet P is pushed in, the insertion portions 21*b* is continuously brought into contact with the respective side surfaces of the rolled sheet P.

As a result of continuously pushing in the rolled sheet P, when each opening portion of the core tube 2 exposed to side surface of the rolled sheet P reaches the position of the each insertion portion 21*b*, as shown in FIGS. 5 and 7, a part of the biased insertion portion 21*b* is inserted into the opening portion so as to fit therein. That is, the pair of bobbins 21 are pressed to the core tube 2, thereby making it possible to support the core tube 2 by sandwiching the core tube 2 from both sides thereof. In this case, the pair of bobbins 21 are just pressed with the insertion portion 21*b* being partially inserted into the opening portion, so the core tube 2 and the rolled sheet P are in a rotatable state. As a result, the rolled sheet P can be pivotally supported.

Figure 8:
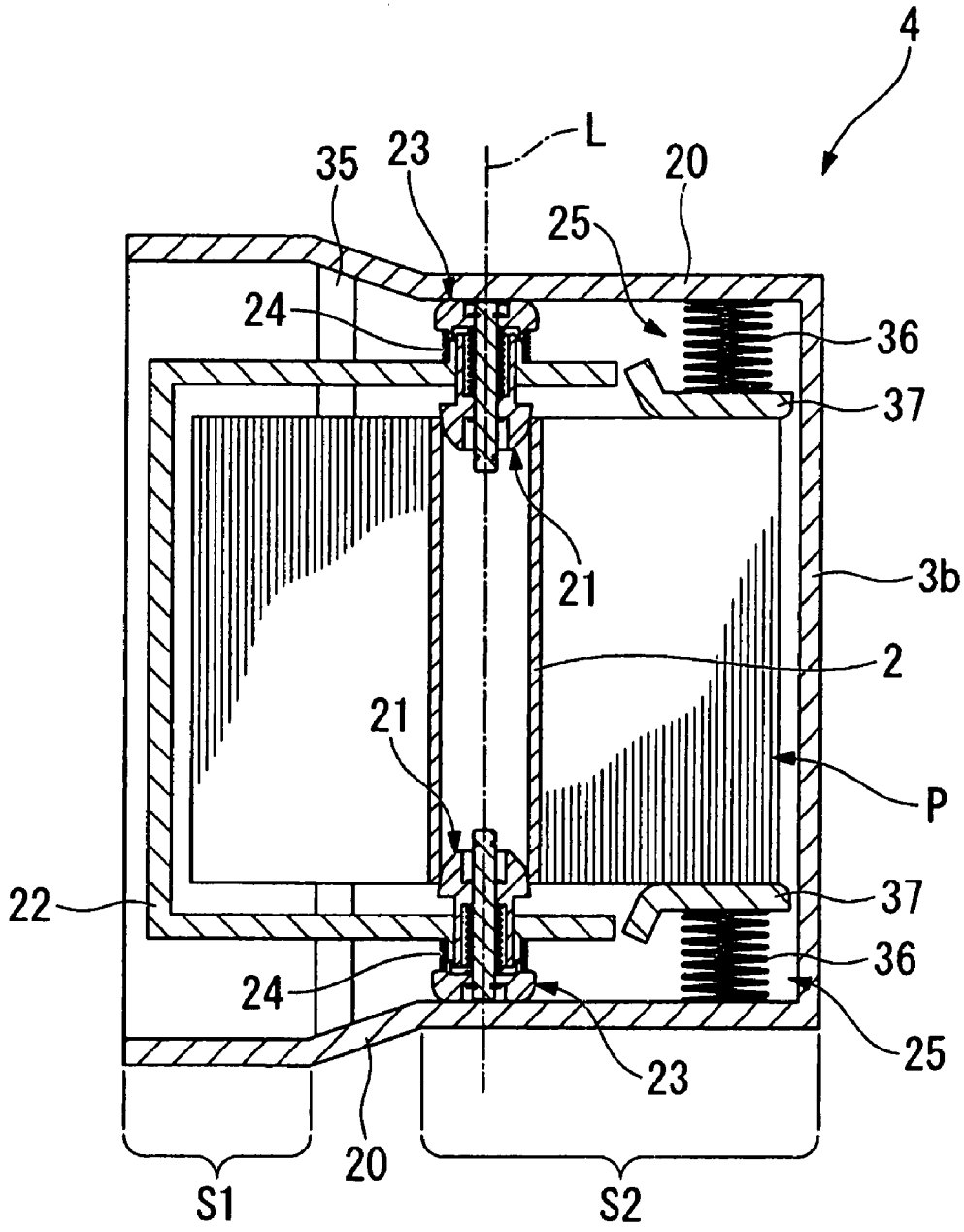
FIG. 8 is a sectional view showing a state where the rolled sheet is displaced to the accommodation position from the state of FIG. 5.

After the rolled sheet P is mounted, as shown in FIG. 3, a certain length of the recording sheet P1 is drawn out. After that, as shown in FIG. 1, the cover member 22 is rotated to be brought into intimate contact with the casing 3. By this rotation movement, the rolled sheet P and the bobbins 21 move to the accommodation position S2 while being integrated to each other as shown in FIG. 8. The end plate 32 moves along the guide plate 20. As shown in FIG. 1, the recording sheet P1 which has been drawn out is drawn out to the front surface of the casing 3 while being sandwiched between the thermal head 5 and the platen roller 6.

Figure 9:
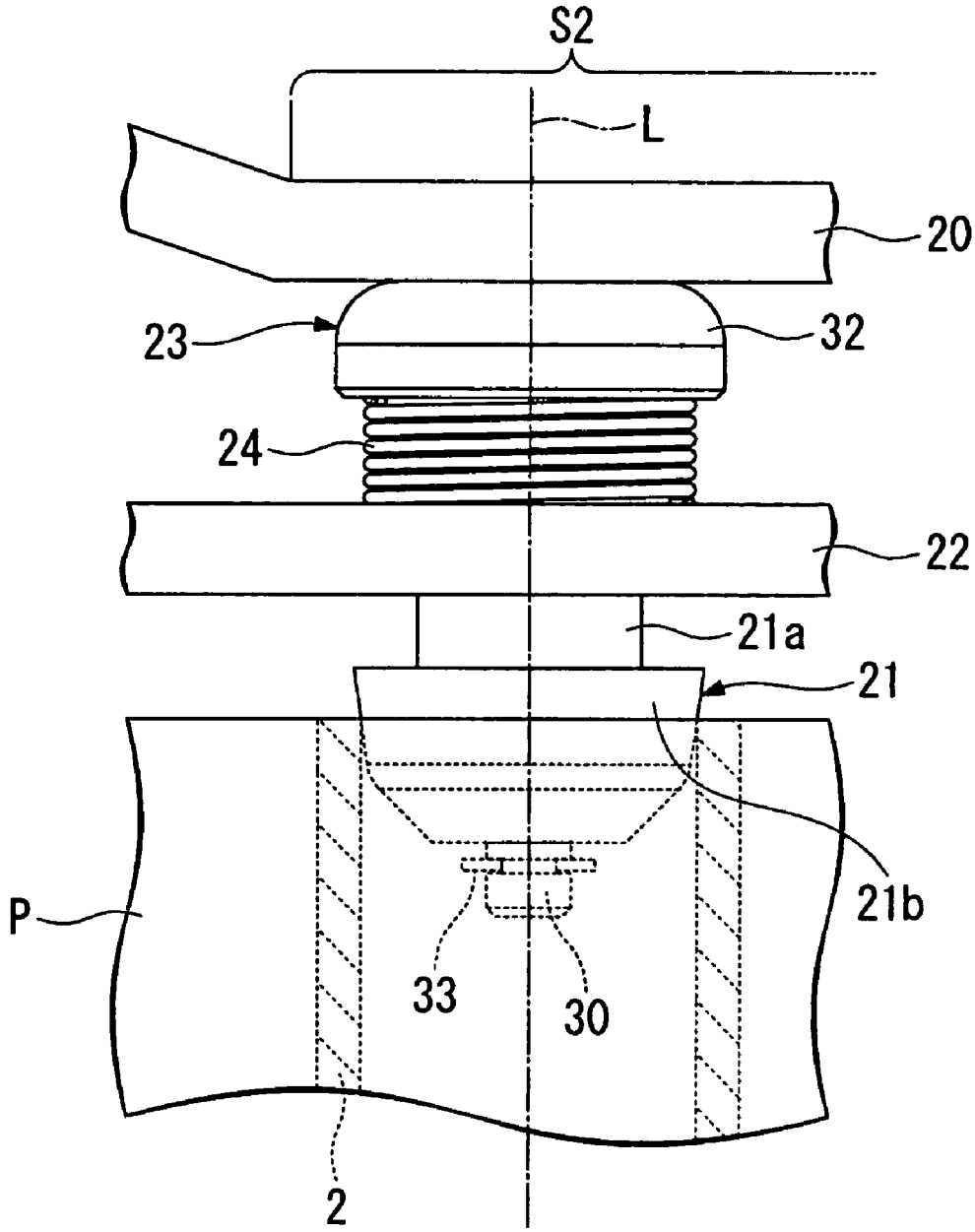
FIG. 9 is an enlarged view of the vicinity of the bobbin in the state of FIG. 8.

Here, the pair of guide plates 20 has such a design that a distance therebetween decreases from the attachment position S1 to the accommodation position S2. Therefore, the bobbins 21 are further pressed to the core tube 2 through the bobbin pressing springs 31. That is, the distance between the pair of guide plates 20 is mechanically smaller in the accommodation position S2 than in the attachment position S1. Thus, as shown in FIG. 9, the bobbin pressing spring 31 is compressed, thereby increasing the elastic force, so the bobbins 21 can be pressed to the core tube 2 with a stronger force. As a result, the rolled sheet P can be pivotally supported in the accommodation position S2 while being sandwiched with a stronger force.

As described above, the distance between the pair of guide plates 2*b* mechanically changes between the attachment position S1 and the accommodation position S2. Therefore, the pressing force of the bobbin 21 can easily be changed. Accordingly, even in a case where the rolled sheet P is unused, thereby being heavy, the rolled sheet P can be pivotally supported in the accommodation position S2 with reliability, so the falling off of the rolled sheet P can be prevented. On the other hand, at a time of replacing the rolled sheet P, the pressing force of the bobbins 21 can be weakened in the attachment position S1. Therefore, an attachment operation of the rolled sheet P can easily be performed in a way similar to that of the drop-in type.

As described above, according to the rolled sheet support mechanism 4 of this embodiment, prevention of falling off of the rolled sheet P and facilitation of the attachment operation thereof at the time of replacement, which are conventionally difficult can be achieved at the same time. Further, when attaching the rolled sheet P, the insertion portion 21*b* of the bobbin 21 is not pressed to the side surface of the rolled sheet P with a strong force. Therefore, it is possible to prevent such deformation that the side surface of the rolled sheet P is dented.

Note that, when removing the rolled sheet P, the cover member 22 is rotated in a reverse direction to position the rolled sheet P in the attachment position S1, and then, an operation reverse to that at the time of mounting described above is performed, thereby achieving the removal.

Further, when the rolled sheet P is moved to the accommodation position S2, as shown in FIG. 8, the compression plates 37 biased by the compression springs 36 are set to a state where the compression plates 37 sandwich the side surfaces of the rolled sheet P from both sides thereof.

Next, printing of various types of information on the recording sheet P1 drawn out from the rolled sheet P is performed.

First, a motor is operated through the control board 10 to rotate the platen roller 6 through a gear transmission mechanism. As a result, as shown in FIG. 1, the recording sheet P1 sandwiched between a peripheral surface of the platen roller 6 and the thermal head 5 is sent out to the front surface of the casing 3, and the rolled sheet P pivotally supported by the rolled sheet support mechanism 4 rotates. At the same time, the thermal head 5 is operated through the control board 10. As a result, the plurality of heat generating elements generate heat as appropriate. Thus, on the recording sheet P1 which has been sent out, various characters, figures, or the like can clearly be printed. As a result, the recording sheet P1 wound to be the rolled sheet P can be used for receipts, tickets, or the like.

Further, during the printing, as described above, the resistance application members 25 each composed of the compression spring 36 and the compression plate 37 press the side surfaces of the rolled sheet P while sandwiching the rolled sheet P from both sides thereof. Therefore, it is possible to apply the rotation resistance to the rolled sheet P. As a result, excessive rotation due to an inertial force can be prevented, so sag at the time of rotation, that is, overrun can be prevented. Note that, the application of the rotation resistance is performed with contribution of not only the resistance application members 25 but also the pair of bobbins 21 pressed to both sides of the core tube 2. Accordingly, when the diameter of the rolled sheet P is equal to or more than a certain value as in the unused sate (when the weight is large, so the inertial force is large), by both the resistance application members 25 and the bobbins 21, the excessive rotation can effectively be prevented.

Figure 10:
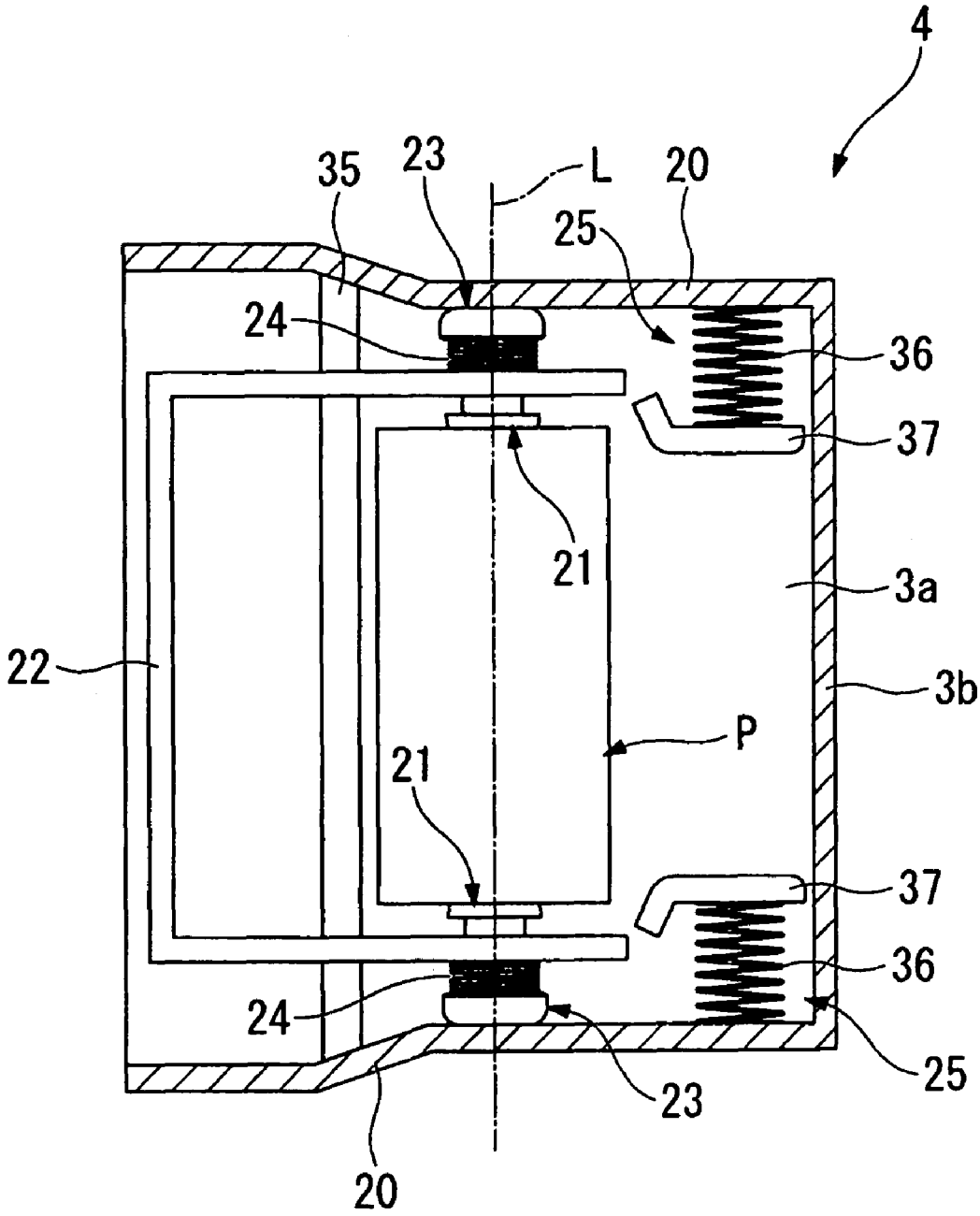
FIG. 10 is a top view of a state where a residual amount of the rolled sheet is reduced from the state shown in FIG. 8.

On the other hand, in a case where, as shown in FIG. 10, a residual amount of the rolled sheet P is reduced and the diameter thereof is less than the certain value, resulting in a small-diameter rolled sheet state, the rotation resistance only by the pair of bobbins 21 is applied. However, even in this case, the inertial force is also reduced in correspondence with the diameter, so the excessive rotation can be prevented, thereby making it possible to prevent the overrun.

In this manner, there is provided the resistance application members 25, so even when the diameter of the rolled sheet P is large as in the case of the unused rolled sheet P, the appropriate rotation resistance can be applied, thereby making it possible to prevent the overrun with reliability.

As described above, since the thermal printer 1 of this embodiment includes the above-mentioned rolled sheet support mechanism 4, the rolled sheet P can be pivotally supported in a stable manner, and the replacement operation can easily be performed. Accordingly, reliability as a printer can be enhanced, and usability and maintainability can be improved.

In particular, the insertion portions 21*b* of the pair of bobbins 21 are formed in a tapered shape, so, when the rolled sheet P is attached, a direction of a force can easily be converted into the direction of the axis L of the core tube 2. Accordingly, the pair of bobbins 21 can be smoothly moved in the direction of the axis L, thereby making it possible to easily perform the replacement operation of the rolled sheet P. Further, when the rolled sheet P is pivotally supported, the tapered surfaces can be pressed to the inner edges of the core tube 2, thereby making it possible to pivotally support the rolled sheet P with reliability.

Further, since the bobbin off spring 24 is interposed between the cover member 22 and the end plate 32, the end plate 32 and the guide plate 20 can continuously be brought into surface contact with each other, and the bobbin 21 can continuously be positioned in the same position with respect to the direction of the axis L. As a result, when the rolled sheet P is not mounted, the position of the insertion portion 21*b* can continuously be retained in the same position with respect to the guide plate 20. Accordingly, when mounting the rolled sheet P, the rolled sheet P can be mounted without being caught or the like, and every time with the same sense of touch. Thus, the mountability is excellent.

Further, in this embodiment, the cover member 22 is rotated by opening and closing, thereby making it possible to displace the rolled sheet P and the bobbins 21 between the attachment position S1 and the accommodation position S2. Accordingly, unlike in the case where the linear displacement is performed, a small space can effectively be utilized, thereby making it possible to downsize the rolled sheet support mechanism 4 and the thermal printer 1. Further, as compared to the case where the linear displacement is performed, the attachment position S1 and the accommodation position S2 can clearly be distinguished according to an opening/closing degree of the cover member 22, so the usability is enhanced.

Note that, the technical scope of the present invention is not limited to the above embodiment. Various modifications may be added without departing from the gist of the present invention.

For example, in the above embodiment, the description has been made by taking the case where the rolled sheet support mechanism 4 is incorporated in the thermal printer 1 as an example. However, the rolled sheet support mechanism 4 is not limited to the use for the thermal printer 1. Further, the bobbins 21 are displaced by opening and closing the cover member 22, but the bobbins 21 may be displaced by linearly moving the cover member 22.

What is claimed is:

1. A rolled sheet support mechanism for pivotally supporting a rolled sheet obtained by winding a recording sheet around a cylindrical core tube, comprising:

a pair of guide plates arranged in parallel to each other while sandwiching the rolled sheet therebetween, and opposed to side surfaces of the rolled sheet;

a pair of support members arranged between the rolled sheet and the pair of guide plates, and having, at ends thereof, insertion portions to be partially inserted into opening portions of the core tube, which are exposed to the side surfaces of the rolled sheet;

a displacement member displaced between an attachment position and an accommodation position for the rolled sheet while supporting the pair of support members movably in an axial direction of the core tube, with the pair of support members being moved along the guide plates when receiving an external force; and a biasing member arranged between each of the guide plates and each of the support members, for biasing the support member with an elastic force in such a direction that the support member is spaced apart from the guide plate and pressing the insertion portion to the core tube in a state where the insertion portion is partially inserted into the opening portion to allow the rolled sheet to be pivotally supported, wherein the pair of guide plates have a distance therebetween, which becomes smaller from the attachment position toward the accommodation position.

2. A rolled sheet support mechanism according to claim 1, wherein the insertion portion is formed into a tapered shape having a diameter gradually reduced toward the opening portion.

3. A rolled sheet support mechanism according to claim 1, further comprising a positioning member between the displacement member and the guide plate, for positioning, when the rolled sheet is not mounted, the pair of support members in predetermined positions with respect to the axial direction.

4. A rolled sheet support mechanism according to claim 1, wherein the displacement member pivotally displaces the pair of support members between the attachment position and the accommodation position.

5. A rolled sheet support mechanism according to claim 4, wherein the displacement member also serves as a cover member for covering the rolled sheet.

6. A rolled sheet support mechanism according to claim 1, wherein the pair of guide plates are provided with resistance application members for applying rotation resistance by pressing the side surfaces of the rolled sheet while sandwiching the rolled sheet from both sides thereof in a case where, when the rolled sheet is positioned in the accommodation position, a diameter of the rolled sheet is equal to or more than a certain value.

7. A thermal printer, comprising:

the rolled sheet support mechanism according to claim 1;

a thermal head having a plurality of heat generating elements and extending in a width direction of the recording sheet;

a platen roller having a peripheral surface which can come into contact with the thermal head in a state where the recording sheet drawn out from the rolled sheet is sandwiched therebetween, for sending out the recording sheet through rotation; and a cutting member for cutting the recording sheet which has passed the thermal head.

8. A rolled sheet support mechanism for pivotally supporting a rolled sheet obtained by winding a recording sheet around a cylindrical core tube, comprising:

a pair of guide plates arranged in parallel to each other with the rolled sheet disposed therebetween, and opposed to side surfaces of the rolled sheet;

a pair of support members arranged between the rolled sheet and the pair of guide plates, and having, at ends thereof, insertion portions partially inserted into opening portions of the core tube, which are exposed to the side surfaces of the rolled sheet;

a displacement member displaceable between an attachment position and an accommodation position for the rolled sheet while supporting the pair of support members movably in an axial direction of the core tube, with the pair of support members being slidable along the guide plates when the displacement member undergoes displacement between the attachment and accommodation positions; and a biasing member arranged between each of the guide plates and each of the support members, for biasing the support member with an elastic force in such a direction that the support member is spaced apart from the guide plate and pressing the insertion portion so that it is partially inserted into the opening portion of the core tube to allow the rolled sheet to be pivotally supported, wherein the pair of guide plates have a distance therebetween, which becomes smaller from the attachment position toward the accommodation position.

9. A rolled sheet support mechanism for rotatably supporting a rolled sheet wound on a core tube, comprising:

a pair of guide plates disposed in opposed spaced-apart relation to each other, the guide plates having opposed first portions and opposed second portions, the opposed first portions being spaced farther apart than the opposed second portions;

a displacement member having a pair of opposed spaced-apart wall portions and being displaceable between an attachment position in which the wall portions are disposed between the opposed first portions of the guide plates and an accommodation position in which the wall portions are disposed between the opposed second portions of the guide plates;

a pair of support members axially slidably mounted to respective ones of the wall portions of the displacement member and partially insertable in an axial direction into opposite ends of a core tube of a rolled sheet when the displacement member is in the attachment position; and a pair of biasing members interposed between the guide plates and the support members for applying an elastic pressing force to the support members to press them to the core tube, the biasing members being in contact with the guide plates and slidable therealong from the opposed first portions to the opposed second portions to increase the pressing force of the support members when the displacement member is displaced from the attachment position to the accommodation position.

10. A rolled sheet support mechanism according to claim 9; wherein the displacement member is configured to partly enclose the rolled sheet.

11. A rolled sheet support mechanism according to claim 9; wherein the displacement member is pivotally mounted to undergo pivotal displacement between the attachment and accommodation positions.

12. A rolled sheet support mechanism according to claim 11; wherein the displacement member is pivotally mounted to the guide plates.

13. A rolled sheet support mechanism according to claim 9; wherein the support members have tapered end portions that are partially insertable into the opposite ends of the core tube.

14. A rolled sheet support mechanism according to claim 9; further including a casing containing the rolled sheet support mechanism, the casing having an opening; and wherein the displacement member constitutes a cover member that closes the opening when in the accommodation position and opens the opening when in the attachment position.

15. A rolled sheet support mechanism according to claim 14; wherein the pair of guide plates constitute opposed side portions of the casing.

16. A rolled sheet support mechanism according to claim 9; wherein the biasing members each comprise a shaft having one end portion axially slidable in an opening in the support member and another end portion connected to an end plate that is in slidable contact with the guide plate, and a pressing spring interposed between the support member and the end plate.

17. A rolled sheet support mechanism according to claim 16; further including another spring that surrounds both the shaft and the pressing spring and that is interposed between the end plate and the wall portion of the displacement member.

18. A rolled sheet support mechanism according to claim 9; further including a pair of resistance application members disposed inwardly of the opposed second portions of the guide plates for applying rotation resistance to the rolled sheet by pressing against opposite sides of the rolled sheet only when the rolled sheet has a diameter equal to or more than a certain value.

19. A rolled sheet support mechanism according to claim 18; further including a casing containing the rolled sheet support mechanism, the casing having an opening; and wherein the displacement member constitutes a cover member that closes the opening when in the accommodation position and opens the opening when in the attachment position.

20. A thermal printer, comprising:

a rolled sheet support mechanism according to claim 9;

a thermal head having a plurality of heat generating elements and extending in a width direction of the recording sheet;

a platen roller having a peripheral surface which can come into contact with the thermal head in a state where the recording sheet drawn out from the rolled sheet is sandwiched therebetween, for sending out the recording sheet through rotation; and a cutting member for cutting the recording sheet which has passed the thermal head.

* * * * *